US008813670B2

(12) United States Patent
Kristensen et al.

(10) Patent No.: US 8,813,670 B2
(45) Date of Patent: Aug. 26, 2014

(54) FLOATING STRUCTURE

(75) Inventors: Per Herbert Kristensen, Rykkinn (NO); Erik Pettersen, Tranby (NO)

(73) Assignee: Moss Maritime AS, Lysaker (NO)

( * ) Notice: Subject to any disclaimer, the term of this patent is extended or adjusted under 35 U.S.C. 154(b) by 1121 days.

(21) Appl. No.: 10/543,488

(22) PCT Filed: Jan. 26, 2004

(86) PCT No.: PCT/NO2004/000021

§ 371 (c)(1),
(2), (4) Date: Jul. 14, 2006

(87) PCT Pub. No.: WO2004/067372

PCT Pub. Date: Aug. 12, 2004

(65) Prior Publication Data

US 2006/0260526 A1 Nov. 23, 2006

(30) Foreign Application Priority Data

Jan. 27, 2003 (NO) ..... 20030424

(51) Int. Cl.
*B63B 35/44* (2006.01)

(52) U.S. Cl.
USPC ..... 114/265

(58) Field of Classification Search
USPC ..... 114/264–267
See application file for complete search history.

(56) References Cited

U.S. PATENT DOCUMENTS

| | | | | |
|---|---|---|---|---|
| 4,886,398 | A * | 12/1989 | Sparks | 405/224 |
| 5,558,467 | A | 9/1996 | Horton | |
| 6,273,018 | B1 * | 8/2001 | Gottsche et al. | 114/264 |
| 6,406,222 | B1 * | 6/2002 | Pollack | 405/224 |
| 6,431,107 | B1 * | 8/2002 | Byle | 114/264 |
| 6,666,624 | B2 * | 12/2003 | Wetch | 405/205 |
| 6,691,784 | B1 * | 2/2004 | Wanvik | 166/355 |
| 6,761,124 | B1 * | 7/2004 | Srinivasan | 114/264 |

FOREIGN PATENT DOCUMENTS

| | | | |
|---|---|---|---|
| EP | 0 357 269 | A | 3/1990 |
| EP | 0 359 702 | A | 3/1990 |
| GB | 2 118 904 | A | 11/1983 |
| GB | 2 351 724 | A | 10/2001 |
| NO | 160069 | | 4/1983 |
| NO | 314028 | B1 | 1/2003 |
| WO | WO-02/47970 | A1 | 6/2002 |
| WO | WO 03/002404 | A1 | 1/2003 |

OTHER PUBLICATIONS

John Murray, "Deepwater dry tree semis are here", E&P Magazines, Sep. 1, 2007, pp. 1-5.

Odd Magnus Faltinsen, "Sea Loads on Ships and Offshore Structures", Cambridge University Press 1990, pp. 78-79.

* cited by examiner

*Primary Examiner* — Daniel V Venne
(74) *Attorney, Agent, or Firm* — Birch, Stewart, Kolasch & Birch, LLP

(57) ABSTRACT

A floating structure 1, for instance a semi submersible platform, comprises a deck structure 2, vertical columns 3 and a pontoon structure 4. The floating structure 1 is moored to the seabed with anchor lines 7. The floating structure is moored with taut line anchoring system, and the vertical stiffness in the anchoring system is approximately 20% of the water plane stiffness for the floating structure. The pontoon structure 4 comprises at least two levels of pontoons and the columns 3 are formed to give variable water plane stiffness.

18 Claims, 3 Drawing Sheets

FLOATING STRUCTURE

BACKGROUND OF THE INVENTION

1. Field of the Invention

The invention relates to a system for dampening the movement of a floating structure, for instance a semi submersible platform, where the floating platform comprises a deck structure, several columns which support the deck structure and penetrate the water plane surface and a pontoon structure and which floating structure is moored to the seabed.

2. Discussion of Related Art

There are several reasons why a floating structure should have as little movement or as reduced heave pitch and roll movement as possible. Especially for floating structures as semi submersible platforms or wellhead platforms are there a strong need to reduce the motion. A wellhead platform normally is understood to be a platform in an oil/gas offshore installation complex which accommodate the production risers of the production streams, preferably with dry wellheads and some process equipment for oil/gas treatment, but normally not full production package for treatment of the hydrocarbons to final export specifications. There will also be export risers, which can be hard risers, flexible risers or steel catenary risers (SCR), since there is limited storage capability in a semi submersible platform.

In order to accommodate dry wellheads, the motion characteristics of the unit must be favourable to reduce tensioner stroke requirements and extra loads on the risers. Traditionally, wellhead platforms have been jackets for small drafts of water and tension leg platforms (TLPs) for larger drafts. Jackets become unsuitable for drafts in excess of a couple of hundred meters. TLP platforms will be expensive and difficult to install for drafts in excess of about 1000 meters. Especially the tethers and the foundations of the TLPs are increasingly complex for the larger drafts.

An ordinary semi submersible platform will not possess the motion characteristics required to allow dry wellheads in most required environments. Such a platform must therefore get special characteristics to reduce the motions to a level that can be acceptable for dry wellhead and their riser tension compensators There have been several attempts to reduce the motion characteristics of a floating structure as a semi submersible platform. Some of these techniques are mentioned below.

In U.S. Pat. No. 4,829,928 and ocean platform has a negative buoyant pontoon suspended from the balance of the platform to increase the heave resonant period to at least 25 seconds. Tendons suspend the pontoon to a depth where dynamic wave forces do not materially act directly on it in seas of normally occurring periods of up to about 15 seconds. Columns and upper pontoon provide buoyancy for the platform.

EP 359 702 describes a semi submersible platform which includes a fully submerged lower hull and a plurality of stabilizing columns which extend from the lower hull to an upper hull. Each column has a dynamic wave zone in the design seaway. At least one column has means adapted to reduce its water plane area to increase the natural heave period of the platform, so that the natural heave period becomes grater than the longest period of any wave with substantial energy in the design seaway, thereby lowering the platform's heave response. These means are a channel which in use becomes flooded with sea water.

U.S. Pat. No. 6,431,107 describes a floating offshore structure with a buoyant hull with sufficient fixed ballast to place the centre of gravity of the floating structure below the centre of buoyancy of the hull. A support structure coupled to an upper end of the hull supports and elevates a superstructure above the water surface. A soft tendon is attached between the hull and the seafloor.

This floating structure has as a consequence a very high natural period during heave, and due to very little restoring force it may have large second orders heave motions. To reduce the second order heave motion the platform is provided with a vertical anchoring system with a vertical stiffness as large as possible but limited so that the resulting natural period during heave is at least 20 second.

SUMMARY OF THE INVENTION

To secure a tension within acceptable limits in the risers and secure the riser and other equipments between the platform and the seabed from damage, is there still with these solutions a necessity to have larger riser tension compensators on the deck structure of the floating structure. These tension compensators have generally a large weight and a method to reduce or eliminate the need for these compensators would give large benefits, since weights is a crucial factor when designing a floating structure and especially a platform structure with processing equipments topside.

The aim for the present invention is to achieve a floating structure which is moored to the seabed with reduced motion characteristics.

It is an aim to especially reduce the heave motion of the floating structure by tuning the natural period of the floating structure in with the cancellation period.

There is also an aim for the present invention to achieve a floating structure that has a favourable motion characteristic during a large range of external conditions, for instance different wavelengths of the waves or swells in the sea.

In addition there is an aim of achieving a floating structure for instance in the form of a semi submersible platform with favourable motion characteristics at the same time as the platform may have larger topside deck loads than the standard semi submersible platforms.

These aims are achieved with a floating structure according to the following independent claims.

In order to reduce the requirements to the riser tension compensators, it is primarily the heave motions that have to be reduced, but pitch/roll motions must also be within acceptable limits.

The present invention relates to a floating structure, for instance a semi submersible platform but it can also be another type of floating platform as a wellhead platform or a smaller process platform. The floating structure comprises a deck structure, mainly vertical columns supporting the deck structure and penetrating the water plane surface, and a pontoon structure. The deck structure may have several levels and there may on the deck be all kinds of equipment and connections point for risers, umbilicals, other lines running from the deck structure to the seabed or installations on the seabed. The floating structure is moored to the seabed, with anchor lines. These anchor lines may be more or less grouped or bundled on for instance four opposite sides of the floating structure or they may be more evenly distributed around the structure.

The mooring of the floating structure is done with a taut line anchoring system, where the vertical stiffness in the anchoring system is approximately 20% of the water plane stiffness for the floating structure, where the water plane stiffness is given by $\rho g A_w$, where $\rho$ is the density of water, g the acceleration of gravity and $A_w$ is the water plane area. This gives behaviour of the floating structure which is favourable especially in relation to an eventually need of tension compensators.

In one aspect of the inventions the anchoring system consists of several anchor lines, which may be steel wires and/or fiber ropes attached between the floating structure and anchors embedded in the seabed.

In one aspect of the inventions the anchoring system consists of several anchor lines, which may be steel wires and/or fibre ropes attached between the floating structure and anchors embedded in the seabed.

In addition gives the present invention a floating structure as mention above which has a favourable motion characteristic in all kinds of conditions by the combination of features regarding the mooring system, the pontoon structure and the configuration of the columns.

In this the pontoon structure comprises at least two levels of pontoons, a first and a second pontoon level, where the pontoon levels is arranged in the vicinity of a bottom part of the vertical columns, the one above the other in the mainly vertical direction, so that water is "trapped" between the two pontoons to give added mass to the floating structure.

The mooring of the floating structure is done as described above, with a taut line anchoring system, where the vertical stiffness in the anchoring system is approximately 20% of the water plane stiffness for the floating structure, where the water plane stiffness is given by $\rho g A_w$, where $\rho$ is the density of water, g the acceleration of gravity and $A_w$ is the water plane area.

As the last feature in the combination the columns are formed to give a variable water plane stiffness, where at least one of the columns have a part penetrating the water plane surface with variable cross section in the vertical direction.

In another aspect of the inventions the section of at least one of the columns penetrating the water plane surface, has a conical shape in the longitudinal direction of the column with the smaller diameter closest to the deck structure. The tapered section has an inclined centreline, where the centreline converges upwards towards a vertical centreline for the floating structure.

For the floating structure the mainly vertical distance between the different pontoon levels is a function of the overlapping area between two neighboring levels in another aspect of the invention. The different pontoon levels may consist of only one pontoon and that the pontoon is partly symmetrical about a centre axis of the floating structure and has a through going central opening. The pontoons in the different levels may be substantially equal in form. The above mentioned mainly vertical distance between the pontoon levels may be in the range of 25 to 40 percent of the horizontal distance between an outermost and an innermost point of the overlapping area between two neighboring pontoons in a radial direction from the centerline of the floating structure.

For the floating structure the mainly vertical distance between the different pontoon levels is a function of the overlapping area between two neighbouring levels in another aspect of the invention. The different pontoon levels may consist of only one pontoon and that the pontoon is partly symmetrical about a centre axis of the floating structure and has a through going central opening. The pontoons in the different levels may be substantially equal in form. The above mentioned mainly vertical distance between the pontoon levels may be in the range of 25 to 40 percent of the horizontal distance between an outermost and an innermost point of the overlapping area between two neighbouring pontoons in a radial direction from the centreline of the floating structure.

The theoretical background for the present invention of a floating structure with the favourable motion characteristic, for instance for the case where there for normal semi submersibles, would be a need for using large riser tension compensators, is as follows.

The heave motion characteristics for a floating object is normally described by Response Amplitude Operators (RAO's), also called transfer functions. A typical RAO for a semi submersible platform is shown in FIG. 3. In the figure the regular wave periods is used as abscissa and the response amplitude pr. m wave amplitude as ordinate. It should be remembered that the RAO is most correctly described by complex numbers, i.e. in addition to the amplitude, also phase angles must be provided.

Such a RAO has some special features. The region pointed out by arrow A is called the cancellation region. The peak below arrow B is the natural period. To the right of the natural period in the figure, it is the water plane stiffness that mostly governs the motions, and the RAO will asymptotically approach 1.0 for long waves, i.e. the unit will "ride the waves".

To the left of the natural period in the figure, the total mass and hydrodynamic excitation forces will be governing for the motions. The cancellation region is caused by the fact that the hydrodynamic excitation forces, with their origin from water particle accelerations and the dynamic pressure under the columns, tend to cancel each other out at this period. This is a very attractive feature for a semi submersible platform, and is a major reason for the favourable motion characteristics of such a platform.

The peak caused by the natural period is, however, a problem in long waves. If there is wave excitation energy in this region, excessive heave motions may be the result. Tuning of the platform to a very long heave natural period could help the problem, but will also worsen the motions in normal and shorter waves. Excessive motions in long waves could be very hampering for a wellhead platform, where the tension compensators could exceed their design stroke and damage the risers. In some regions, where use of such wellhead platforms is in use (e.g. West of Africa) swells with extra long periods occur and can cause problems if the response is not reduced.

There are several strategies for reducing the effect of the natural period of the heave.

The present invention gives a solution of how to tune the natural period to the cancellation period. It can be shown mathematically that the natural period will always exist at longer periods than the cancellation period for a free floating object. These two periods can therefore not be tuned without external stiffness contribution.

The invention is to provide this external extra stiffness by means of the mooring system of the unit.

By using a taut wire system, there will be a significant vertical stiffness in addition to the horizontal mooring stiffness. Since a taut wire system has no line element resting on the bottom and the catenary effect is small, it is the elastic stiffness of the lines that compose the vertical stiffness.

It has been found that if the mooring system has a vertical stiffness corresponding to about 20% of the water plane stiffness, the natural period correspond to the cancellation period. The water plane stiffness is defined as $\rho g A_w$, where:

$A_w$ is the water plane area

P is the density of water and g is the acceleration of gravity.

Analysing the invented platform with hydrodynamic programs has confirmed this. One analysis is carried out by means of the program AQWA-LINE. This is a linear sink-source program for frequency domain analysis. The other program is AQWA-NAUT. This is a program using the hydrodynamic coefficients from the sink-source solution, but calculates real (non-linear) restoring. The program operates in the time domain, where the coefficients are mapped from frequency to time domain.

The results from both analyses are shown in FIG. 4. As shown, the natural period has been eliminated by the cancellation in both analyses. The resulting heave motion when exposed to waves with long periods will not be adversely affected by the heave natural period any longer. This platform can consequently be used in regions where long periodic waves (swells) exist.

In order to achieve a floating structure which have a favourable motion characteristic in all kinds of conditions with respect of heave, pitch and roll it is a necessity to combine the above mentioned feature with other features for the floating structure.

The design should be such that the natural period is at higher wave periods than the wave excitation spectrum. Since the natural period is a function of the total mass and the water plane stiffness, this can be achieved by increasing the mass and reducing the water plane stiffness as much as permissible. In the present invention, this has been achieved by entrapping a large amount of water between the several levels of pontoons, favourable two levels of pontoons. This gives a larger added mass than normally achieved by ordinary (small draft) semi submersible platforms.

The magnitude of the natural period peak is dependent on the damping of the structure at the natural period. In the present invention, the structure with several levels of pontoons, create a large viscous damping due to a large surface and the water flow in the split between the pontoons. This also gives the possibility of having a larger load on the superstructure of the platform.

Disturbing the uniquely defined natural period by having variable water plane stiffness can also reduce the magnitude of the natural period. The natural period will therefore not have a constant value but will depend on the motion amplitude. It is a well-known fact that such non-linearity in stiffness will reduce the response amplitude. This solution is described in the applicants own application PCT/NO02/00228, where design does consequently have a conical section in the water plane area to provide this non-linearity. This design will also reduce parametric couplings between heave and pitch/roll motions.

By combining the three different features for a floating structure, one achieves a floating structure which has a superior motion characteristic for all kinds of conditions. These features complement each other in an unexpected way and give a favourable platform construction which is simple and have the benefit of being able to have not only an addend mass on the deck structure but at the same time being within the desired motion characteristics with respect to heave, pitch roll so that it is especially suitable as a well head platform with dry wellheads. This means one can produce a relatively compact and small platform whit a lot more functionality than a normal semi submersible platform, and thereby achieve cost benefits.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

In the following the invention will be explained with reference to the following drawings where.

DETAILED DESCRIPTION OF THE ILLUSTRATED EMBODIMENTS

Figure 1:
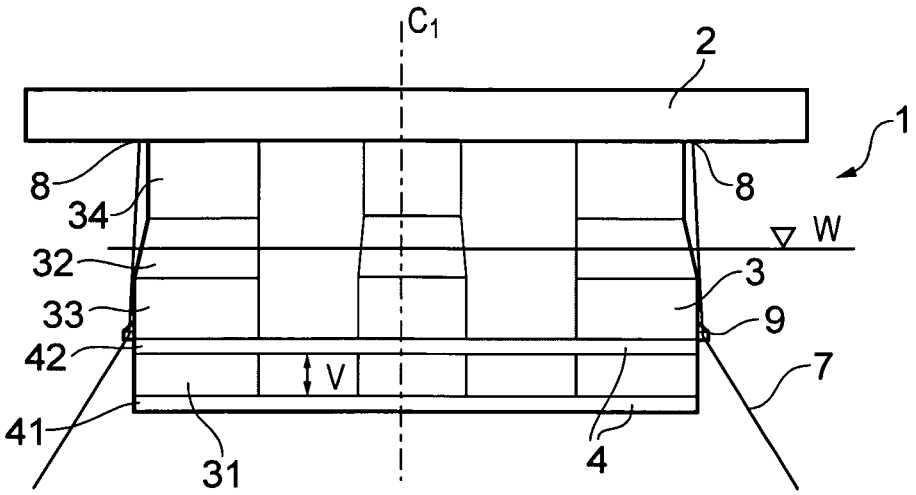
FIG. 1 is a side view of a floating structure, a semi submersible platform according to the present invention.

The present invention will now be described in detail with reference to the accompanying drawings, wherein the same reference numerals will be used to identify the same or similar elements throughout the several views. It should be noted that the drawings should be viewed in the direction of orientation of the reference numerals.

FIG. 1 shows a floating structure 1 according to the invention. The floating structure 1 is in this case a semi-submersible platform. The platform comprises a deck structure 2. Four vertical columns 3 support the deck structure 2. The columns 3 run from the deck structure 2, penetrate the water plane surface W and are in the bottom part 31 connected to a pontoon structure 4. The pontoon structure 4 is mainly horizontal. The floating structure 1 is moored to the seabed with anchor lines 7. The anchor lines 7 run from the connection point 8 to the floating structure 1, which in this case is on the deck structure 2, toward the seabed through anchor line guides 9.

The mooring of the floating structure 1 is done with taut line anchoring system, where the vertical stiffness in the anchoring system is approximately 20% of the water plane stiffness for the floating structure. The vertical stiffness in the anchoring system can be achieved in several ways and it will be up to a person skilled in the art to choose the most suitable way.

The columns 3 of the floating structure 1 are mainly vertical, and have a cylindrical shape in the vertical direction. The columns 3 are positioned symmetrical about a centre axis C1 of the floating structure 1. The columns 3 have a first cylindrical section 33 with a diameter D1, which section comprises the bottom part 31 to which the pontoon structure 4 is connected. Above the first cylindrical section 33 there is a section 32 which penetrates the water surface W during wave motions. This section 32 is tapered from a diameter D1 equal to the diameter for the first cylindrical section 33 to a second diameter D2 which is smaller than the first diameter D1. The centre line for the tapered section 32 of the columns 3 is inclined so that it converges upwards with the centreline C1 of the floating structures. The columns continue vertically upwards with a second cylindrical section 34 with a mainly vertical centreline and with a diameter equal to the second diameter D2. The second cylindrical section supports the deck structure 2 of the semi submersible platform.

Figure 2:
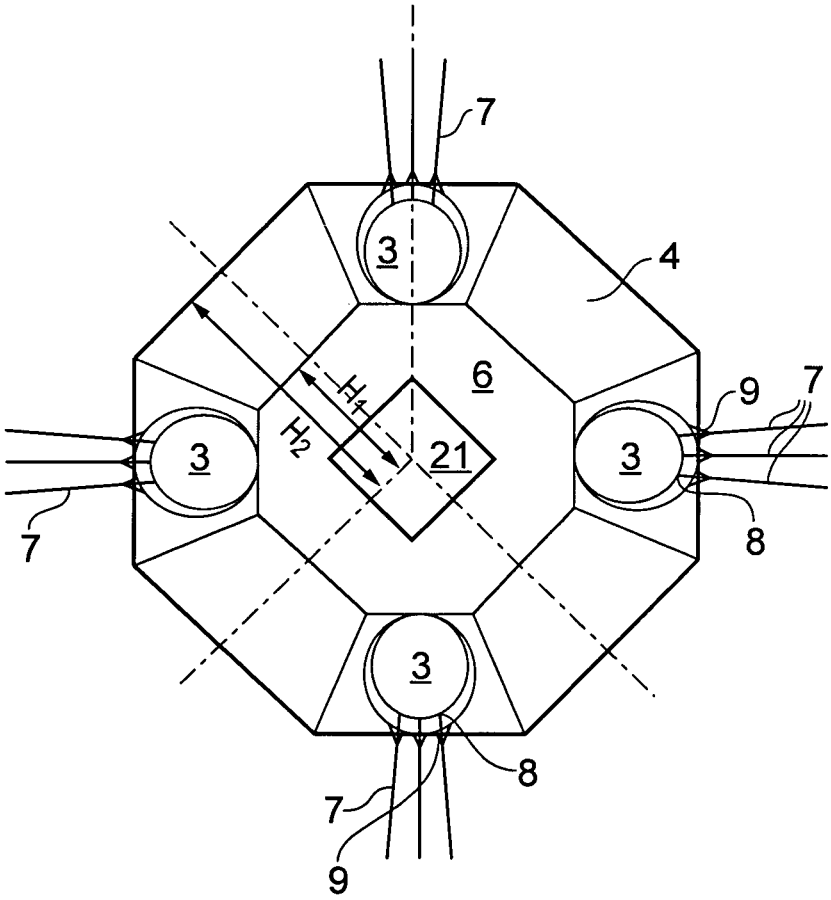
FIG. 2 shows a principal sketch of the platform in FIG. 1 seen from above, FIG. 3 a diagram showing the typical heave transfer function (RAO) for a semi submersible platform.
Figure 3:
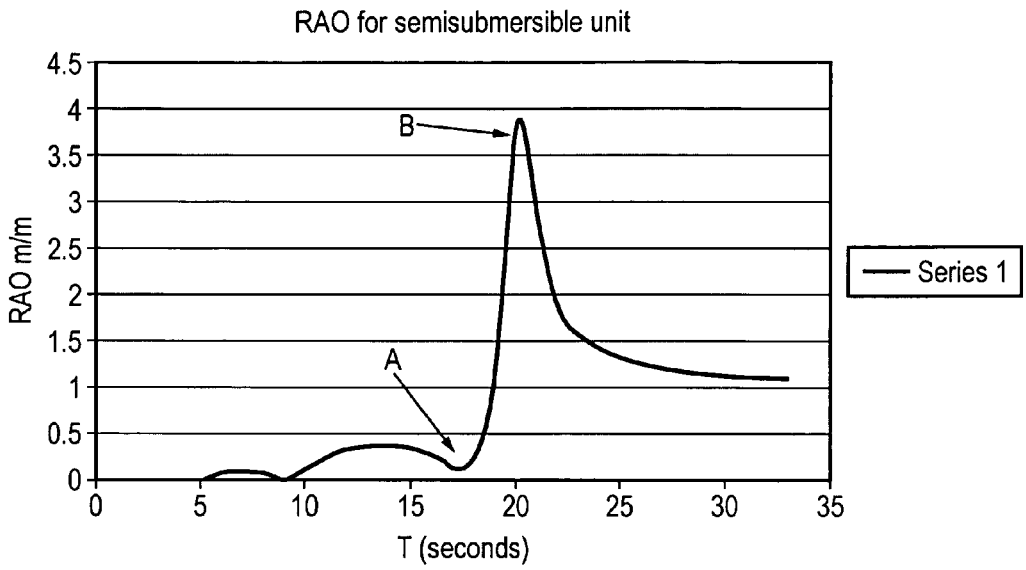
Figure 4:
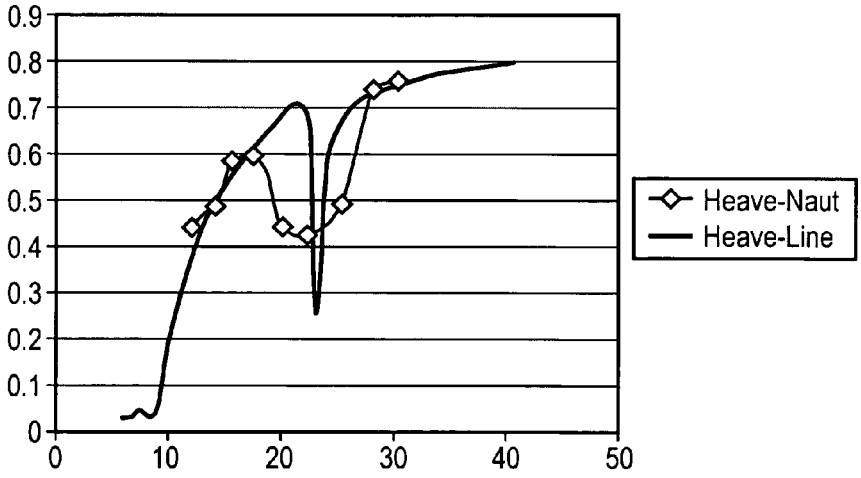
FIG. 4 is a diagram showing the cancellation of the heave natural period for a semi submersible platform in accordance with the invention.

The semi submersible platform will naturally have risers, and in other cases umbilicals, drill strings etc, which are not shown in the figures running from the seabed or the well or other submerged installation to the top of deck structure 2 through a moon pool 21. The moon pool 21 is shown schematically in FIG. 2, but risers etc. are not shown in the figures to make the figures more clear. The deck structure will also have other equipment necessary for performing the desired processes on the deck structure and exit risers to other offshore facilities.

The pontoon structure 4 of the platform 1 consist in this embodiment of the invention of a two level structure, with a first pontoon level 41 and a second pontoon level 42. In this embodiment the two pontoon levels 41 and 42 respectively, are equal and each level provide an octagonal ring shaped unitary pontoon, symmetrical about the centreline C1 of the floating structure 1. The width of the ring shaped pontoon is determined by the difference between the distance H2 from the centreline of the floating structure to the outer perimeter of a section part of the octagonal shaped pontoon and the distance H1 from the centreline to the inner perimeter of the same section part. The different pontoon levels 41 and 42 are in a mainly vertical distance V from each other. The octagonal shape is found advantageous, but other designs may be favourable, dependent of the circumferential parameters and the use of the floating structure.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

Figure 5:
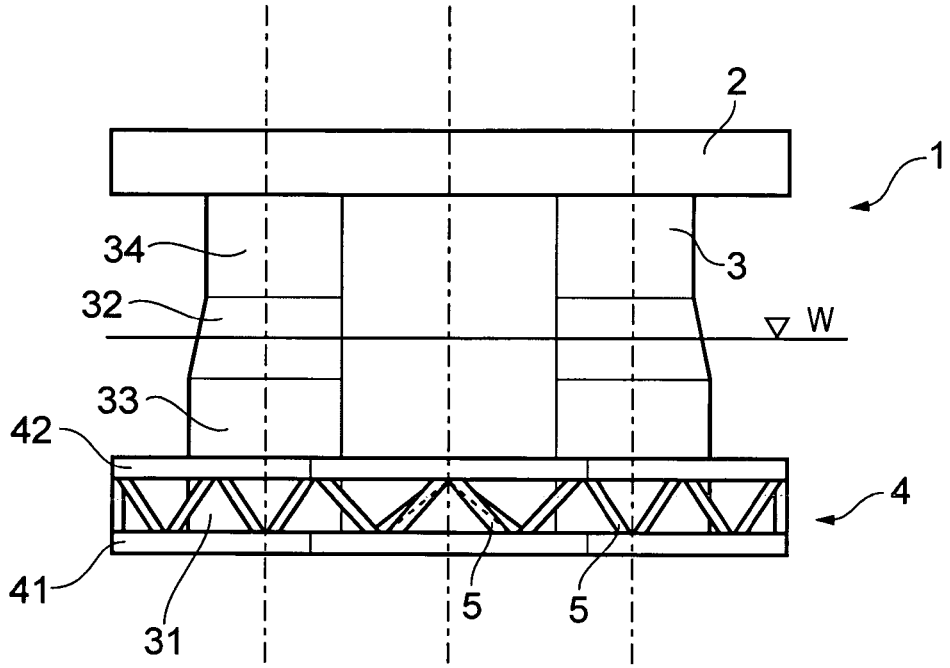
FIG. 5 shows a second embodiment of the semi submersible platform shown in FIG. 1.

As shown in the second embodiment in FIG. 5 there may be trusses 5 between the different pontoon levels 41, 42 respectively, in the pontoon structure 4.

The invention claimed is:

1. A floating structure comprising a deck structure, mainly vertical columns supporting the deck structure and penetrating the water plane surface, and a pontoon structure, the floating structure being moored to the seabed, wherein the floating structure is moored with a taut line anchoring system such that a heave natural period of the floating structure corresponds to a cancellation period of the floating structure by providing a vertical stiffness in the anchoring system which is approximately 20% of the waterplane stiffness for the floating structure, the waterplane stiffness being defined by ρgAw, wherein ρ is the density of water, g is the acceleration of gravity and Aw is the waterplane area.

2. The floating structure according to claim 1, wherein the anchoring system consists of several anchor lines, which may be steel wires and/or fiber ropes attached between the floating structure and anchors embedded in the seabed.

3. The floating structure according to one of the preceding claims, wherein at least one of the columns has a section penetrating the waterplane surface with variable cross section in the mainly vertical direction, so that the floating structure has variable waterplane stiffness.

4. The floating structure according to claim 3, wherein the section of the column penetrating the water plane surface, has a conical shape in the longitudinal direction of the column with the smaller diameter closest to the deck structure and with an inclined centreline, wherein the centreline converge upwards towards a vertical centreline (C1) for the floating structure .

5. The floating structure according to claim 1, wherein the pontoon structure comprises at least two levels of pontoons, a first and a second pontoon level, wherein the pontoon levels is arranged in the vicinity of a bottom part of the vertical columns, the one above the other in the mainly vertical direction, so that water is trapped between the two pontoons to give added mass to the floating structure.

6. The floating structure according to claim 5, wherein the mainly vertical distance (V) between the different pontoon levels is a function of the overlapping area between two neighboring levels.

7. The floating structure according to claim 5 or 6, wherein each of the different pontoon levels consist of one unitary pontoon for each level and that the pontoon for each level is partly symmetrical about a centre axis (C1) of the floating structure and has a through going central opening.

8. The floating structure according to claim 5, wherein the pontoons in the different levels are substantially equal in form.

9. The floating structure according to claim 7, wherein the mainly vertical distance (V) between the pontoon levels is in the range of 25 to 40 percent of the horizontal distance (H1, H2) between an outermost and an innermost point of the overlapping area between two neighboring pontoons in a radial direction from the centreline (C1) of the floating structure.

10. A floating structure comprising a deck structure, vertical columns supporting the deck structure and penetrating the water plane surface, and a pontoon structure, the floating structure being moored to the seabed with anchor lines, wherein the pontoon structure comprises at least two levels of pontoons, a first and a second pontoon level, the pontoon levels being arranged in the vicinity of a bottom part of the vertical columns, one above the other in a mainly vertical direction, so that water is trapped between the two pontoons to give added mass to the floating structure, the floating structure is moored with a taut line anchoring system such that a heave natural period of the floating structure corresponds to a cancellation period of the floating structure by providing a vertical stiffness in the anchoring system which is approximately 20% of the water plane stiffness for the floating structure, the water plane stiffness being defined by ρgAw, wherein ρ is the density of water, g is the acceleration of gravity and Aw is the water plane area, and the columns are formed to give a variable water plane stiffness, wherein at least one of the columns have a section penetrating the water plane surface with variable cross section in the vertical direction.

11. A floating structure which is designed with a heave natural period and a cancellation period, the floating structure comprising:

a deck structure, mainly vertical columns supporting the deck structure and penetrating the water plane surface, and a pontoon structure, wherein the floating structure is moored to the sea bed such that the heave natural period of the floating structure corresponds to the cancellation period of the floating structure.

12. The floating structure according to claim 11, wherein the floating structure is provided with a waterplane stiffness which is defined by ρgAw where ρ is the density of water, g is the acceleration of gravity and Aw is the waterplane area, and wherein the vertical stiffness in the anchoring system is approximately 20% of said waterplane stiffness.

13. The floating structure according to claim 11, wherein at least one of the columns has a section penetrating the waterplane surface with variable cross section in the mainly vertical direction, so that the floating structure has variable waterplane stiffness.

14. The floating structure according to claim 13, wherein the section of the column penetrating the water plane surface has a conical shape in the longitudinal direction of the column with the smaller diameter closest to the deck structure and with an inclined centreline, wherein the centreline converge upwards towards a vertical centreline (C1) for the floating structure.

15. The floating structure according to claim 11, wherein the pontoon structure has an octagonal shape in a cross section perpendicular to a vertical center line (C1) of the floating structure.

16. The floating structure according to claim 11, wherein the floating structure is a semi-submersible platform.

17. A floating structure for reducing heave motion, the floating structure being designed with a heave natural period and a cancellation period and comprising:

a deck structure, mainly vertical columns supporting the deck structure and penetrating the water plane surface, and a pontoon structure, wherein the floating structure is moored to the seabed with an anchoring system and the vertical stiffness in the anchoring system is adjusted such that the heave natural period of the floating structure corresponds to the cancellation period of the floating structure.

18. The floating structure according to claim 17, wherein the floating structure is moored to the seabed with a taut line anchoring system and wherein the vertical stiffness in the anchoring system is adjusted such that the vertical stiffness is approximately 20% of the waterplane stiffness for the floating structure, the water plane stiffness being defined by $\rho gAw$, where $\rho$ is the density of water, g is the acceleration of gravity and Aw is the waterplane area.

* * * * *